United States Patent [19]

Hutson

[11] Patent Number: 4,753,253

[45] Date of Patent: Jun. 28, 1988

[54] NAIL FILING DEVICE

[76] Inventor: Howard A. Hutson, 779 Kinnikiniik Hill, Mt. Vernon, Golden, Colo. 80401

[21] Appl. No.: 946,361

[22] Filed: Dec. 24, 1986

[51] Int. Cl.[4] ..... A45D 29/05

[52] U.S. Cl. ..... 132/73.6; 132/75.8

[58] Field of Search ..... 132/73.6, 75.3, 75.6, 132/75.8, 76.4; 51/4, 102, 104, 241 G

[56] References Cited

U.S. PATENT DOCUMENTS

| | | | |
|---|---|---|---|
| 2,056,379 | 10/1936 | Acocella | 132/73.6 |
| 2,258,012 | 8/1939 | Jeannotte | 132/75.8 |
| 2,389,665 | 10/1944 | Harris | 132/75.8 |
| 2,923,303 | 3/1958 | Hundt | 132/75.8 |
| 3,018,782 | 3/1963 | Funk | 132/73.6 |
| 3,216,034 | 4/1964 | Johnson | 15/23 |
| 3,596,667 | 8/1971 | Buercklin et al. | 132/73.6 |
| 4,117,854 | 10/1978 | Rosenbloom | 132/75.8 |
| 4,213,471 | 7/1980 | Burian et al. | 132/73.6 |
| 4,408,623 | 10/1983 | Murray | 132/75.8 X |
| 4,643,207 | 2/1987 | Grahame | 132/73.6 |

FOREIGN PATENT DOCUMENTS

| | | | |
|---|---|---|---|
| 677817 | 8/1952 | Australia | 132/76.4 |
| 1355632 | 2/1963 | France | 132/73.6 |

*Primary Examiner*—Robert P. Swiatek
*Assistant Examiner*—Thomas Price
*Attorney, Agent, or Firm*—Sheridan, Ross & McIntosh

[57] ABSTRACT

An apparatus for quickly and accurately trimming a nail is provided. The apparatus comprises a grippable housing having an integral insertion portion. The insertion portion is designed to guide the nail towards a rotating filing member within the housing and is also designed to press back the flesh underlying the nail. The insertion portion comprises a first surface joined to a second surface at an acute angle along a common edge. The tapered wedge formed by the two surfaces permits the surfaces to be optimally inserted along the underside of the nail to thereby isolate the nail from the adjacent flesh. Also, the common edge formed by the two surfaces is convex so that the nail filing device can be readily moved around the periphery of the nail. The device allows the user to precisely control the extent of the trimming by assessing the pressure of the insertion portion against the flesh underlying the nail and by visually observing the contact of the nail with the rotating filing member.

8 Claims, 1 Drawing Sheet

NAIL FILING DEVICE

FIELD OF THE INVENTION

The present invention relates to an apparatus for filing fingernails and toenails and, more particularly, to an apparatus having a portion adapted to be inserted betweent he nail and the flesh underlying the nail, wherein the insertable portion includes two surfaces joined at an acute angle.

BACKGROUND OF THE INVENTION

The chore of trimming nails can be greatly eased by the use of devices having motor driven reciprocating and rotating abrasive members. Unlike hand operated filing devices, which must be simultaneously reciprocated against and maneuvered around a nail, the powered devices require only that the user maneuver the abrasive surface around the nail while the abrasive action is supplied by the rotating or reciprocating abrasive member. The powered devices consequently allow a person to more easily and quickly trim his or her nails than the hand operated filing devices. Additionally, the power devices allow persons with limited movement to trim their nails without the difficult or often impossible burden of reciprocating the abrasive member to abrade the nail.

A number of the powered filing devices have been patented. For example, the patent to Jeannotte (U.S. Pat. No. 2,258,012) discloses an apparatus having a rotating filing member adapted to file a nail inserted through a limited opening. The patent to Rosenbloom (U.S. Pat. No. 4,117,854) discloses a powered nail fliling apparatus having a slot-like opening adjacent a spring biased touch plate. The tip of the finger is pressed against the touch plate to bring the nail into contact with the filing member. The patent to Hundt (U.S. Pat. No. 2,923,303) discloses a powered nail filing device with a guide member comprising a concave edge for receiving the end of the finger. The guide member is spring biased to urge the tip of the finger away from the abrasive wheel.

These patents show the use of a limited opening or slot to insure that only the nail contacts the filing member and the use of a resilient member pressing against the top of the finger to prevent contact of the flesh with the filing member. However, the inclusion of the safety features in the filing devices disclosed in these patents diminishes their effectiveness in accurately and thoroughly trimming a nail. For example, the slots in these devices are generally positioned in flat or concave surfaces which limit the user's control in guiding the device along the periphery of the nail. Consequently, a user must carefully control the movement of these patented filing devices in order to traverse the entire periphery of the nail. Also, the flat or concave surfaces surrounding the slot oftentimes prevents the user from visually determining the extent to which the nail has been filed by the rotating filing member. The user must therefore frequently interrupt the filing operation by withdrawing the nail to determine the extent of the trimming. An additional drawback of these devices is that a person having limited control of his hands and fingers has difficulty in summoning the requisite control and sensitivity needed to properly trim his nails with these filing devices. Accordingly, there exists a need for a powered filing device which allows the user to readily traverse the periphery of the nail in a convenient and rapid manner while also allowing the user to visually determine that the nail is being trimmed to the proper extent. Also, the need exists for a device which minimizes undesired contact between the flesh adjacent the nail and the rotating filing member, without sacrificing the control needed for accurate nail trimming.

SUMMARY OF THE INVENTION

An apparatus is disclosed for quickly and precisely filing fingernails and toenails. The apparatus of the present invention overcomes several disadvantages associated with known devices including, in particular, the disadvantage of a relativley slow and frequently interrupted filing operation due to the presence of unwieldy safety features. The apparatus of the present invention overcomes the disadvantages of the known devices with a configuration which contacts more of the sensitive skin beneath the nails than the known devices. Also, the apparatus of the present invention achieves greater ease of operation and increased control through a novel construction and design which is simple and economical.

The apparatus comprises a housing adapted to be gripped by one hand and having a nail receiving portion. The nail receiving portion includes a powered abrasive member positioned slightly above a first surface. The first surface projects outward beyond the powered abrasive member and forms an acute angle with a second surface along a common lower edge. The common edge formed by the first and second surfaces faces outward of the housing and is adapted to be readily inserted underneath the portion of the nail to be trimmed so that the second surface can beneficially contact, press back and protect the flesh underlying the nail.

In a preferred embodiment of the invention, the nail receiving portion is substantially perpendicular to the gripping portion of the housing to facilitate convenient use of the apparatus. Also, to accommodate use of the apparatus as both a fingernail and a toenail filing device, a second insertable common upper edge is provided. The two common edges form a slot for nail insertion. Additionally, the two edges are substantially convex so that the apparatus can be readily maneuvered around the generally rounded periphery of a nail. Each common edge is formed by two surfaces which are acutely angled to one another. One of the two surfaces forming each of the two common edges is preferably parallel to the plane of rotation of the rotating filing member so that a portion of the nail to be trimmed can be slid along the surface and brought into contact with the rotating filing member.

It is an object of this invention to provide an apparatus for filing a nail which easily positions the nail for the filing operation.

It is another object of this invention to provide an apparatus for filing a nail which can be quickly maneuvered around the periphery of the nail with a high degree of control.

It is a further object of this invention to provide an apparatus for filing a fingernail or toenail which minimizes harmful contact between the flesh adjacent the nail and the nail filing member of the apparatus.

It is yet a further object of this invention to provide an apparatus for filing a nail which is conveniently grippable for use in filing both fingernails and toenails.

It is yet a further object of this invention to provide an apparatus for filing a nail which allows a user to optimally control the apparatus when a nail is filed.

Other objects and advantages of the invention will be apparent from the following more particular description of a preferred embodiment as illustrated in the accompanying drawings.

DETAILED DESCRIPTION OF THE PREFERRED EMBODIMENT

Figure 1:
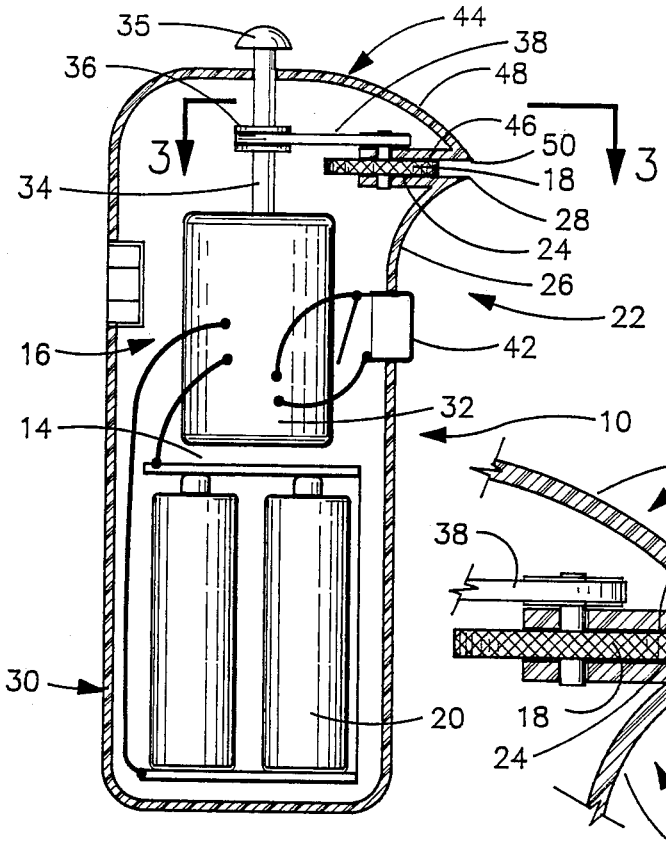
FIG. 1 is a partial sectional view of a structure illustrating a preferred embodiment of the apparatus of the present invention.

With reference to FIG. 1, a nail filing preferred embodiment of the apparatus 10 of the present invention is shown. The nail filing apparatus 10 is portable and is designed to file the periphery of a toenail or a fingernail 12 (shown in FIG. 2). The apparatus 10 comprises a housing 14 which encases a power assembly 16 adapted to rotate a rotatable abrasive member 18. The power assembly 16 can be powered by rechargeable batteries 20 or by connection to an electrical outlet (not shown).

The rotating abrasive member 18 is positioned so that its rotating edge abrades the periphery of nail 12 when the nail is inserted into housing 14 in a manner to be described shortly. To insure that the flesh adjacent nail 12 is not exposed to the rotating abrasive member 18, a first wedge assembly 22 is provided which projects outward from housing 14 and is adapted to provide a solid protective structure between rotating abrasive member 18 and the flesh underlying nail 12. First wedge assembly 22 comprises a flat surface 24 joined to a curved surface 26 along a common edge 28. First wedge assembly 22 is positioned so that common edge 28 projects outward beyond rotating abrasive member 18 so as to engage the flesh underlying the nail.

Figure 2:
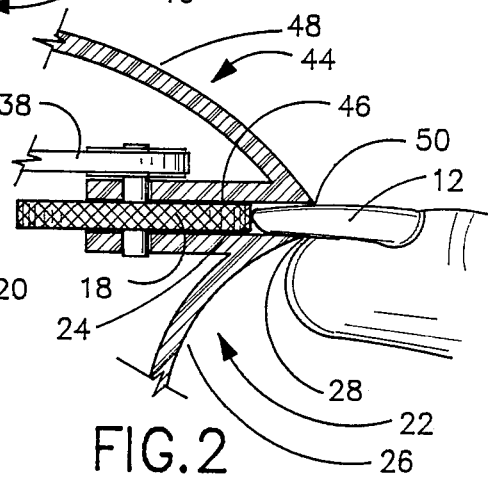
FIG. 2 is an exploded view of the wedge assembly and rotating abrasive member of a preferred embodiment of the present invention.
Figure 3:
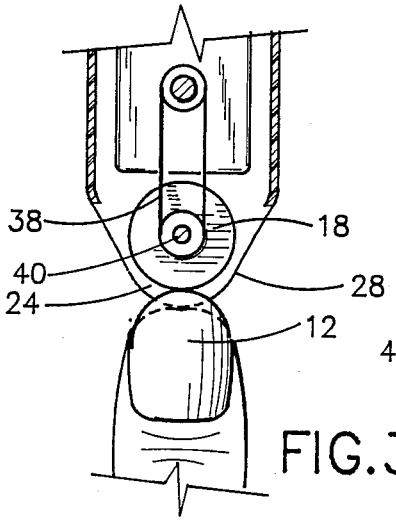
FIG. 3 is a top view of the preferred embodiment of the present invention.
Figure 4:
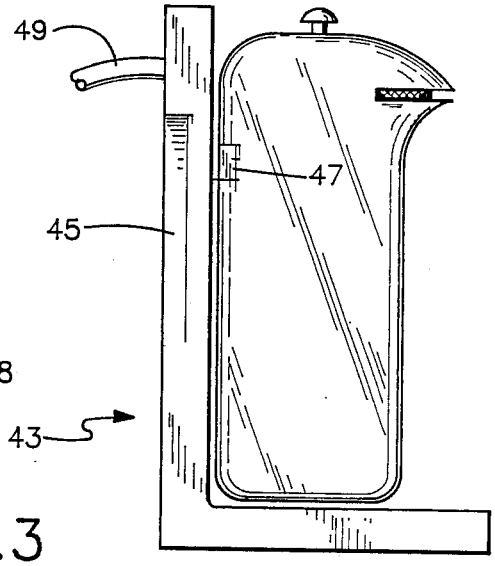
FIG. 4 is a side view showing the preferred embodiment of the present invention in combination with a recharging device.

Flat surface 24 is aligned parallel to and slightly below (with regard to FIG. 1) the plane of rotation of rotating abrasive member 18. Flat surface 24 and curved surface 26 are positioned at an acute angle to one another and are joined along the common edge 28 in order to accomplish the desirable object of providing a solid protective surface which can be inserted under nail 12 to a comfortable extent. As best seen in FIG. 2, flat surface 24 and curved surface 26 form a tapered wedge which is conveniently insertable between the underside of nail 12 and the flesh underlying the nail. The acute angle construction allows the two surfaces to be sufficiently inserted so as to allow for substantial contact between surface 26 and the flesh under the nail, thereby providing for optimal control in the operation of the apparatus while minimizing the opportunity for undesired contact between the flesh and the abrasive member 18. As shown in FIG. 3, common edge 28 is generally semi-circular and the midpoint of the semi-circle is positioned in the direction in which first wedge assembly 22 is inserted under nail 12. It is contemplated, however, that common edge 28 can be of any convex shape. The semi-circular shape of common edge 28 permits the rotating abrasive member 18 to follow the curved periphery of nail 12. The user moves apparatus 10 in a semi-circular pattern around nail 12 so that common edge 28 is progressively moved about and under nail 12 in a semi-circular fashion. This motion can be repeated until the nail 12 is filed to the desired length. As common edge 28 is progressively inserted under and about the curved nail portion to be trimmed, curved surface 26 simultaneously engages and pushes back the flesh underlying the nail. Consequently, rotating abrasive member 18 can file the entire curved periphery of nail 12 to yield an evenly trimmed nail and to minimize any danger that the rotating member 18 will be exposed to the flesh underlying nail 12.

With further regard to housing 14 and power assembly 16, housing 14 comprises a gripping portion 30 which is substantially perpendicularly oriented with respect to the plane of rotation of rotating abrasive member 18. The perpendicular orientation permits the to more easily grasp and move the apparatus 10 during the filing operation. Power assembly 16 is compactly designed to fit within housing 14 so that housing 14 is easily grippable and is balanced when gripped. With reference to FIG. 1, power assembly 16 comprises a motor 32 secured within housing 14 and having a drive shaft 34. Drive shaft 34 rotates a power takeoff pulley 36 mounted on the end of the shaft and an optional nail polisher 35, or other similar attachment, mounted to drive shaft 34 above power takeoff pulley 36. A drive belt 38 is mounted for non-slipping movement around power takeoff pulley 36 and a receiving pulley 40 which is coaxially fixed to rotating abrasive member 18. It will be seen from the foregoing that rotation of drive shaft 34 is transmitted to rotating abrasive member 18 by drive belt 38. Rotation of rotating abrasive member 18 is thus controlled by rotation of drive shaft 34 by motor 32.

Nail polisher 35, or any similar attachment, is co-axial with drive shaft 34 and comprises a suitable contact surface for polishing a nail. The contact surface is mounted at one end of a shaft whose other end is selectively engageable for rotation with the top of drive shaft 34 so that both shafts rotate together. The rotating action of nail polisher 35 can be used to polish or buff a nail. A switch 42 activates motor 32 for selective rotation of rotating abrasive member 18 or the nail polisher 35.

Motor 32 can be powered by rechargeable batteries 20 or by current drawn from an electrical outlet. To recharge the rechargeable batteries 20, a carrier base plate 43 having a transformer 45 can be provided. Carrier base plate 43 is adapted to secure the apparatus 10 and connect the batteries 20 to the transformer 45 via a jack 47. A plug 49 integral with the base plate 43 conducts current from an electrical outlet to transformer 45. Transformer 45 transforms the current and transmits the current via the jack 47 to the batteries 20 to accomplish the recharging.

To use the apparatus 10 in trimming fingernails, the user grasps gripping portion 30 with one hand and positions first wedge assembly 22 against the tip of the finger so that nail 12 is guided towards rotating abrasive member 18 by flat surface 24 while curved surface 26 presses against the flesh on the underside of the nail. When nail 12 contacts rotating abrasive member 18, the user depresses switch 42 to cause rotating abrasive member 18 to rotate and abrade the nail. Simultaneously, the user beigns to move apparatus 10 in a semi-circular path so as to progessively insert common edge 28 under the periphery of nail 12. When one end of the periphery of nail 12 has been reached, the user moves apparatus 10 back along the semi-circular arc to engage the remaining unfiled portions of nail 12 and the filing continues until the other end of the periphery of nail 12 is reached. To control the extent to which nail 12 is trimmed, the user can rely upon both the tactile sensation of curved surface 26 pressing against the underlying flesh and his visual observation of the extent to which nail 12 is inserted along flat surface 24 and against rotating abrasive member 18.

For ease of use in filing toenails and to shield abrasive member 18, apparatus 10 preferably includes a second wedge assembly 44 designed to protect the flesh underlying the toenails in a manner similar to the protection offered by first wedge assembly 22 when filign fingernails. Second wedge assembly 44 is positioned so that it is insertable between a toenail and the underlying flesh when housing 14 is held so that gripping portion 30 is positioned above second wedge assembly 44, as would occur when the user bends over to file his toenails with apparatus 10. As can be understood, the user, when filing his toenails, holds apparatus 10 in a vertical orientation which is the reverse of the vertical orientation of the apparatus when it is used to file fingernails.

Second wedge assembly 44 comprises a flat surface 46 aligned parallel to and slightly above (with regard to FIG. 1) the plane of rotation of rotating abrasive member 18. Flat surface 46 is acutely angled with respect to a curved surface 48 along a common edge 50. Common edge 50 is generally convex or rounded. Second wedge assembly 44 projects further outward from housing 14 than rotating abrasive member 18 so that common edge 50 can engage and press back the underlying flesh before the toenail is contacted by rotating abrasive member 18.

To use apparatus 10 in trimming a toenail, the user grasps apparatus 10 around gripping portion 30 and leans forward to position the tip of the toe against second wedge assembly 44. The toenail is guided towards rotating abrasive member 18 by flat surface 46 while curved surface 48 engages and presses back the underlying flesh. The user then depresses switch 42 to cause rotating abrasive member 18 to rotate and simultaneously moves the apparatus 10 in an arc so as to file the entire periphery of the toenail. The provision of second wedge assembly 44 provides an advantage over an apparatus having only one wedge assembly such as first wedge assembly 22 since it allows the gripping portion of apparatus 10 to face towards the user during the filing of toenails.

Although the present invention has been described with reference to a particular embodiment, it is to be understood that variations and modifications can be effected within the spirit and scope of the invention. Thus, for example, a reciprocating abrasive member may be used in place of rotating abrasive member 18. Also, first wedge assembly 22 and second wedge assembly 44 need not project beyond housing 14 but may be suitably positioned elsewhere on or in housing 14. Additionally, common edges 28 and 50 need not be semi-circular but can be of any other convex shape which facilitates the insertion of the common edges underneath the nail.

What is claimed is:

1. A nail filing device comprising:

(A) a housing having a longitudinal center axis and including:

(i) a gripping portion adapted to be gripped substantially about said longitudinal center axis of said housing;

(ii) a first member for receiving a nail,. said first member extending outwardly and away from said longitudinal center axis of said housing and having at least a first surface and a second surface, said first and second surfaces of said first member being joined at an acute angle to one another along a common first outer edge; and (iii) a second member for receiving a nail, said second member extending outwardly and away from said longitudinal center axis of said housing and having at least a first and a second surface, said first and second surfaces of said second member being joined at an acute angle to one another along a common second outer edge, wherein said first outer edge and second surface of said first member are spaced apart from said second outer edge and second surface of said second member to define an opening in said housing between said first member and said second member, and wherein said opening has a central axis which transverses said longitudinal center axis of said housing; and (B) a driven abrasive filing member positioned within said housing and adjacent to said opening and adapted to abrade the periphery of a nail inserted into said opening, wherein in using said device for filing a fingernail at least a portion of said first outer edge and second surface of said first member is positionable under said fingernail when said fingernail is inserted into said opening, and wherein in using said device for filing a toenail at least a portion of said second outer edge and second surface of said second member is positionable under said toenail when said toenail is inserted into said opening.

2. A nail filing device as claimed in claim 1 wherein: said first member is substantially perpendicular to said longitudinal center axis of said housing.

3. A nail filing device as claimed in claim 1 wherein: at least a portion of said common first outer edge is substantially convex.

4. A nail filing device as claimed in claim 1 and further comprising:

a rechargeable power source adapted to power said abrasive filing member and means for interconnecting said rechargeable power source to an external power source.

5. A nail filing device as claimed in claim 1 wherein: said abrasive filing member comprises a rotatable abrasive body adapted to abrade a nail inserted in said opening.

6. A nail filing device as claimed in claim 1 wherein: at least a portion of said common second outer edge is substantially convex.

7. A nail filing device as claimed in claim 1 and further comprising:

means for polishing a nail surface.

8. A nail filing device as claimed in claim 1 wherein said abrasive filing member has a central axis which is substantially parallel to and offset from said longitudinal center axis of said housing.

* * * * *